US005418604A

United States Patent [19]

Nagakura et al.

[11] Patent Number: 5,418,604

[45] Date of Patent: May 23, 1995

[54] IMAGE FORMING METHOD AND APPARATUS WITH AUTOMATIC SKEW CONTROL

[75] Inventors: Masanao Nagakura; Hiroji Uchimura; Yasunori Hamada; Nobuyuki Hayashida; Haruhisa Inagaki; Yoji Houki, all of Kawasaki, Japan

[73] Assignee: Fujitsu Limited, Kawasaki, Japan

[21] Appl. No.: 103,789

[22] Filed: Aug. 10, 1993

[30] Foreign Application Priority Data

Sep. 28, 1992 [JP] Japan ..... 4-257928
Sep. 29, 1992 [JP] Japan ..... 4-260281

[51] Int. Cl.[6] ..... G03G 21/00; G03G 15/00

[52] U.S. Cl. ..... 355/208; 355/308; 355/309; 355/317

[58] Field of Search ..... 355/208, 308, 309, 317, 355/321; 271/18, 109, 110, 111, 264, 265

[56] References Cited

U.S. PATENT DOCUMENTS

| | | | |
|---|---|---|---|
| 5,056,771 | 10/1991 | Beck et al. | 271/265 X |
| 5,104,110 | 4/1992 | Haibara | 271/265 X |
| 5,136,342 | 8/1992 | Ida et al. | 355/317 |
| 5,216,472 | 6/1993 | Muto et al. | 355/309 X |
| 5,277,415 | 1/1994 | Kinoshita et al. | 271/110 |
| 5,278,623 | 1/1994 | Kasahara et al. | 355/317 |

*Primary Examiner*—Fred L. Braun

*Assistant Examiner*—Sandra L. Brase

*Attorney, Agent, or Firm*—Staas & Halsey

[57] ABSTRACT

Disclosed are an image forming method for checking pickup of a sheet on which an image is to be formed before correcting skewing of the sheet, and an image forming apparatus. This method comprises a first step of permitting a pickup roller to pick up a sheet from a sheet retaining unit and causing the leading edge of the sheet to abut against resist rollers; a second step of permitting a detecting mechanism to detect that the sheet has been picked up by the pickup roller; a third step of rotating the pickup roller by a predetermined amount according to the detection of the detecting mechanism; a fourth step of driving the resist rollers to feed the sheet and driving an image forming mechanism for forming an image on the sheet; and a fifth step of permitting the image forming mechanism to form an image on the fed sheet. The apparatus comprises a sheet retaining unit for retaining sheets; a pickup roller for picking up a sheet from the sheet retaining unit; resist rollers against which the leading edge of the sheet abuts; an image forming mechanism for forming an image on a sheet fed by the resist rollers; a detecting mechanism for detecting that the sheet has been picked up by the pickup roller; and a controller for rotating the pickup roller, then rotating the pickup roller by a predetermined amount according to a sheet detection output of the detecting mechanism, then stopping rotating the pickup roller, and then rotating the resist rollers.

31 Claims, 18 Drawing Sheets

IMAGE FORMING METHOD AND APPARATUS WITH AUTOMATIC SKEW CONTROL

BACKGROUND OF THE INVENTION

1. Field of the Invention

The present invention relates to an image forming method of correcting skew of a sheet picked up from a sheet retaining unit before forming an image on this sheet, and an image forming apparatus employing this method, and, more particularly, to an image forming method of surely accomplishing skew correction and an image forming apparatus employing this method.

2. Description of the Related Art

Image forming apparatuses, such as a copying machine, a printer and a facsimile, employ a latent image forming type recording apparatus like an electrophotographing apparatus, due to a recent demand for image recording on normal sheets of paper. According to this image forming principle, after a photosensitive drum as a latent image carrier is precharged, the photosensitive drum is exposed to a light image to have an electrostatic latent image formed thereon. This electrostatic latent image is developed by a developing unit so that a toner image is formed on the photosensitive drum. This toner image is then transferred onto a sheet of paper.

In this image forming apparatus, sheets on which an image is to be formed are retained in a sheet cassette, and should be picked up therefrom for a later imaging process. The sheets may be skewed when being picked up from the sheet cassette. When an image is formed on a skewed sheet, the image is also formed askew. To prevent it, the image forming apparatus is provided with a mechanism of correcting skew of the picked-up sheet.

FIGS. 1A and 1B are explanatory diagram of prior art, the former showing the structure of the prior art and the latter presenting a time chart of the prior art.

As shown in FIG. 1A, a sheet is picked up by a pickup roller 92 from a sheet cassette 91 retaining a plurality of sheets, and abuts against resist rollers 93. As the leading edge of the sheet abuts against the resist rollers 93, the sheet is bent and tends to return to the original form. This restoring force eliminates the skewing of the sheet. Thereafter, the resist rollers 93 are rotated to feed the sheet forward. A toner image formed on a photosensitive drum 90 of the image forming mechanism is transferred onto the sheet by a transfer roller 94.

In this image forming apparatus, the image forming mechanism starts the image forming operation in accordance with the pickup of the sheet. The image forming apparatus therefore needs a mechanism for detecting the sheet pickup. Because foreign matter such as sheet powder is likely to be produced and a developer scatters in the apparatus which forms a toner image, an inexpensive and small photosensor cannot be used as the sheet detecting mechanism.

Accordingly, a mechanical sheet sensor BS is used as the sheet detecting mechanism. According to the prior art, this sheet sensor BS is provided at the subsequent stage of the resist rollers 93 to detect a sheet feed through the resist rollers 93 so that the supply of the sheet to the image forming mechanism is checked. That is, as shown in FIG. 1B, when the pickup roller 92 is driven for a given time, a sheet abuts against the resist rollers 93 and skewing is thus considered as corrected. Then, the resist rollers 93 are driven to feed the sheet while the photosensitive drum 90 is rotated, and image writing by a laser beam starts, thus forming an image.

At this time, if the sheet sensor BS does not detect any sheet within a given period of time after the driving of the resist rollers 93, the rotation of the resist rollers 93 and photosensitive drum 90, which have been driven, is stopped as indicated by the broken lines in FIG. 1B.

But, the skew correction by the resist rollers 93 needs a constant and stable amount of bending of sheets (resist amount). Conventionally, this resist amount is determined by the expected amount of rotation of the pickup roller 92 on the premise that the picked-up sheet always abuts against the resist rollers 93. If the pickup roller 92 and a sheet slip on each other or a similar incident occurs at the time of sheet pickup, therefore, the resist amount of the sheet becomes non-uniform or insufficient so that the sheet may be fed forward without skew correction.

Further, since non-arrival of the sheet at the resist rollers 93 due to sheet pickup failure or the like is detected by the sheet sensor BS, such detection cannot be accomplished before the driving of the resist rollers 93 and the photosensitive drum 90. This means the requirement of wasteful driving of the photosensitive drum, which is one factor to shorten the service life of the photosensitive drum.

SUMMARY OF THE INVENTION

It is therefore a primary object of the present invention to provide an image forming method for surely executing skew correction of sheets and an image forming apparatus using this method.

It is another object of the present invention to provide an image forming method capable of detecting non-arrival of a sheet due to pickup failure or the like before driving resist rollers, etc., and an image forming apparatus using this method.

It is a different object of the present invention to provide an image forming method of stably controlling the amount of sheet bending or slacking, and an image forming apparatus using this method.

It is a further object of the present invention to provide an image forming method of controlling the amount of sheet slacking after the arrival of a picked-up sheet at resist rollers, and an image forming apparatus using this method.

It is a still further object of the present invention to provide an image forming method which detects the arrival of a picked-up sheet at resist rollers by means of a detecting mechanism with a simple structure, and an image forming apparatus using this method.

To achieve the foregoing and other objects and in accordance with the purpose of the present invention, an image forming apparatus according to this invention comprises a sheet retaining unit for retaining sheets; a pickup roller for picking up a sheet from the sheet retaining unit; resist rollers against which a leading edge of the sheet abuts; an image forming mechanism for forming an image on a sheet fed by the resist rollers; a detecting mechanism for detecting that the sheet has been picked up by the pickup roller; a first motor for rotating the pickup roller; a second motor for rotating the resist rollers; and control means for driving the first motor to rotate the pickup roller, then driving the first motor by a predetermined amount in accordance with a sheet detection output of the detecting mechanism, then stopping driving the first motor, and then driving the second motor.

An image forming method according to this invention comprises a first step of permitting a pickup roller to pick up a sheet from a sheet retaining unit retaining sheets and causing a leading edge of the sheet to abut against resist rollers; a second step of permitting a detecting mechanism to detect that the sheet has been picked up by the pickup roller; a third step of rotating the pickup roller by a predetermined amount in accordance with the detection of the detecting mechanism; a fourth step of driving the resist rollers to feed the sheet and driving an image forming mechanism for forming an image on the sheet; and a fifth step of permitting the image forming mechanism to form an image on the fed sheet.

According to the present invention, since a sheet is detected by the detecting mechanism between the pickup roller and resist rollers, the resist amount can be controlled by the pickup roller after the sheet is detected by the sheet detecting mechanism. This can prevent insufficient skew correction due to an insufficient resist amount. Further, as sheet pickup failure can be detected before the driving of the resist rollers, wasteful activation of the resist rollers can be prevented.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 1A:
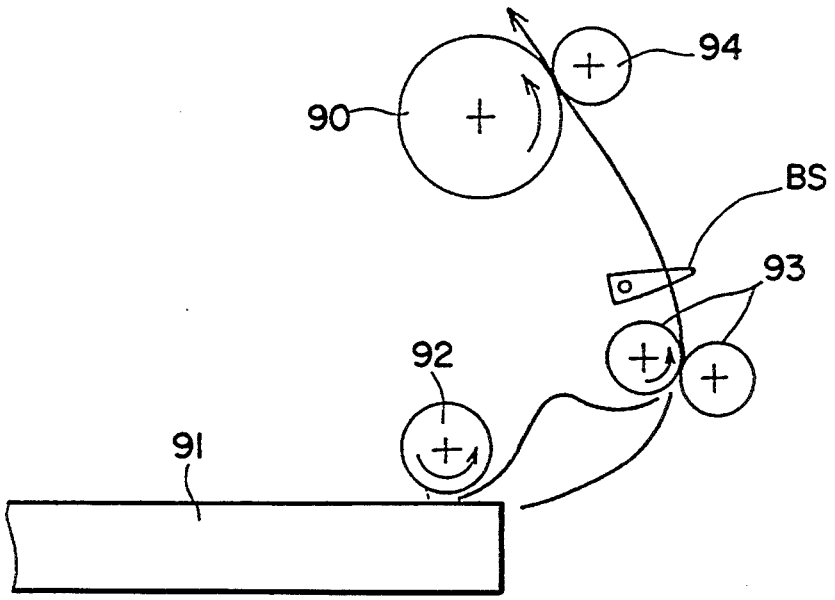
FIG. 1A PRIOR ART
FIGS. 1A and 1B are explanatory diagrams of prior art.
Figure 1B:
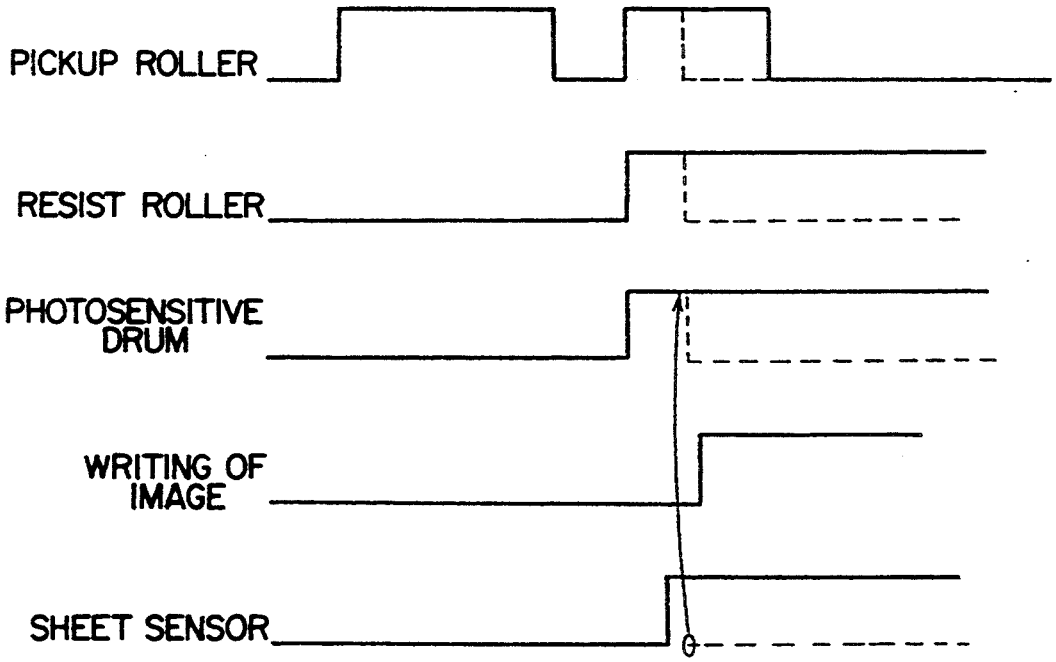
FIG. 1B PRIOR ART
Figure 2:
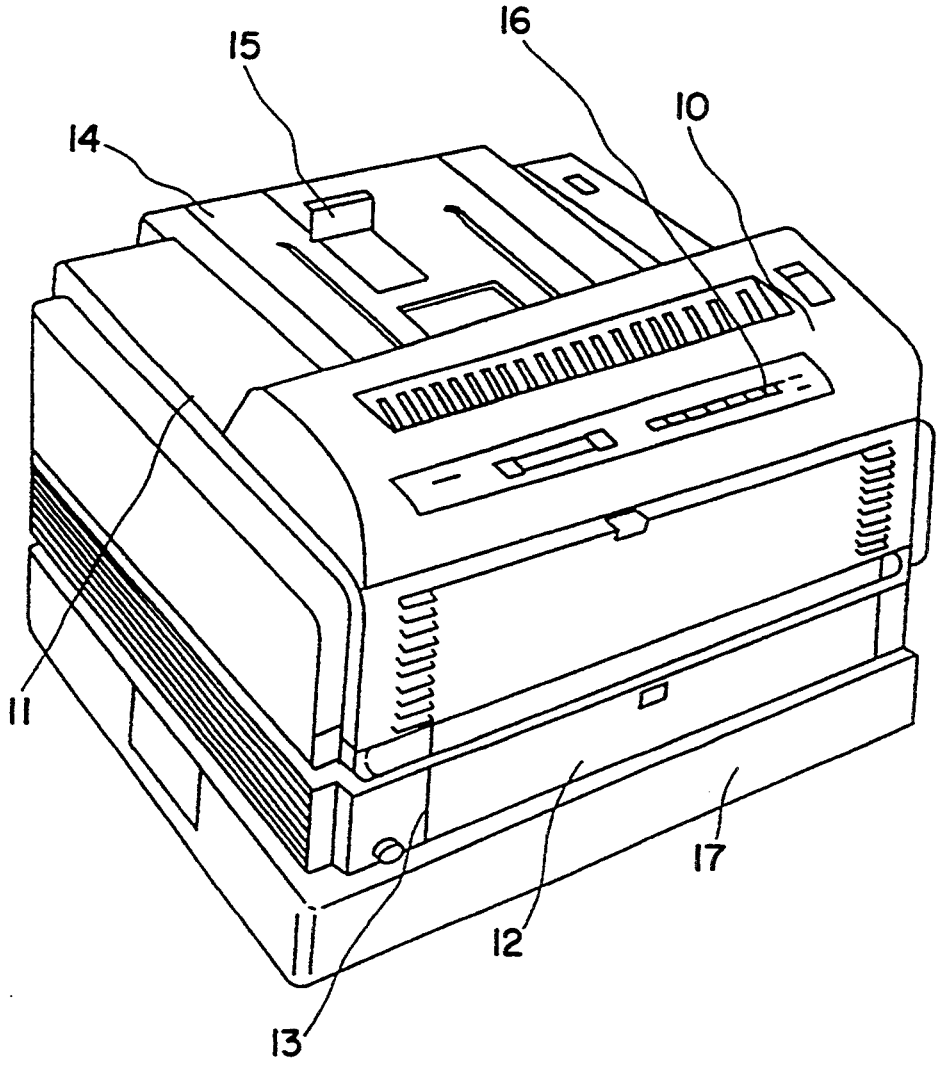
FIG. 2 is a perspective view showing the outline of an image forming apparatus according to one embodiment of the present invention.
Figure 3:
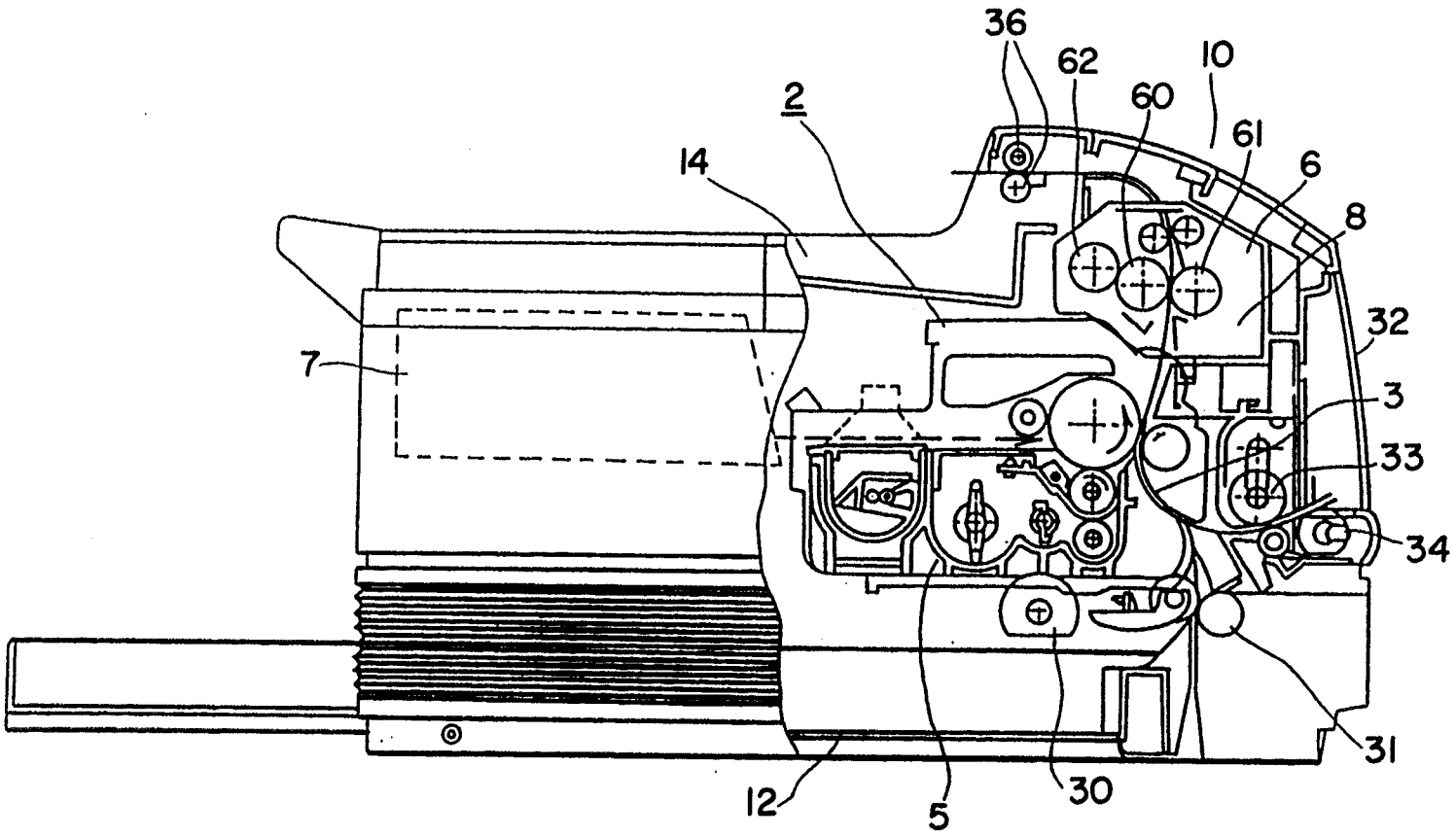
FIG. 3 is a cross-sectional view showing the interior of the image forming apparatus shown in FIG. 2.
Figure 4:
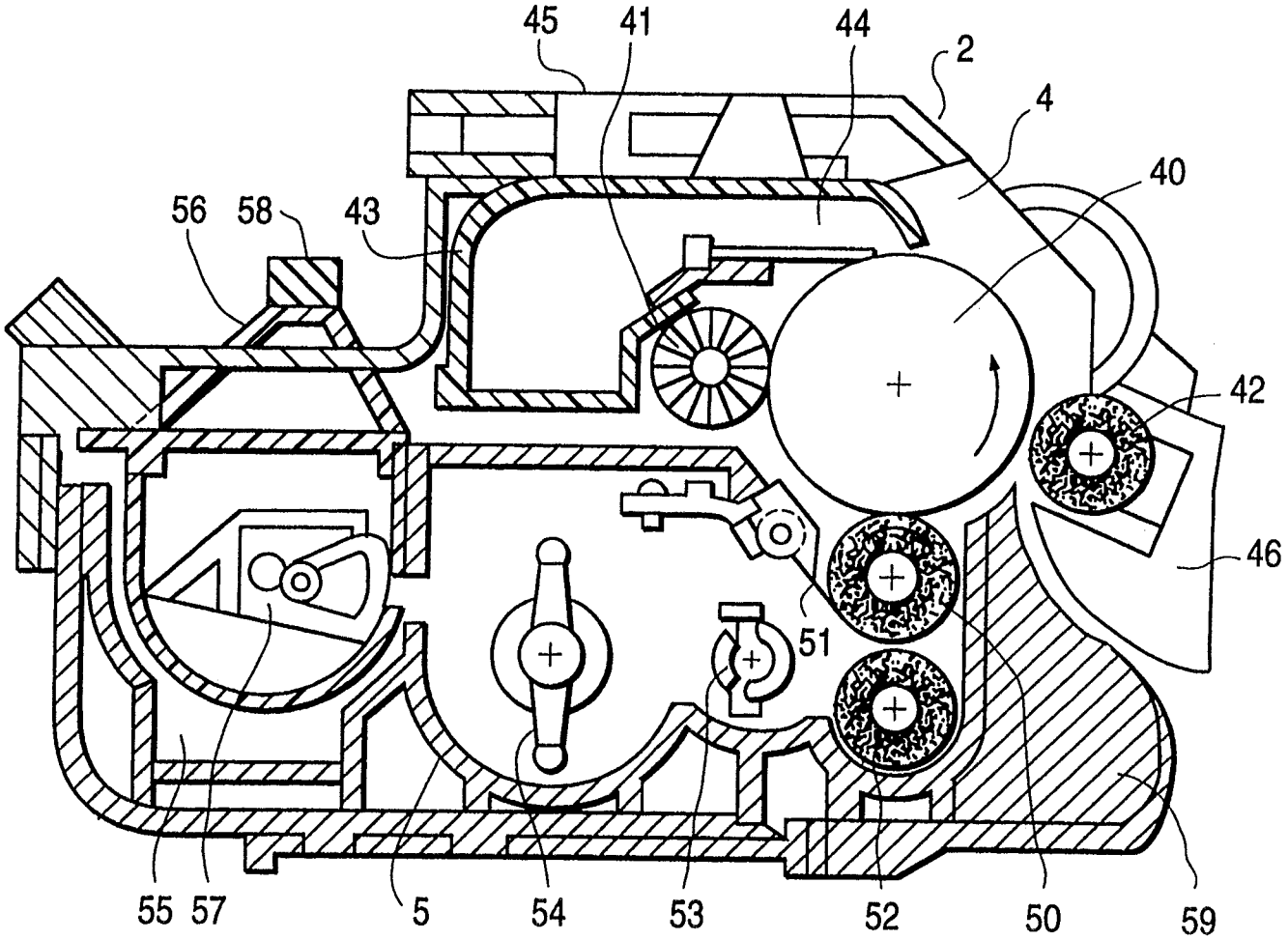
FIG. 4 is a cross section of a process cartridge of the image forming apparatus shown in FIG. 3.
Figure 5:
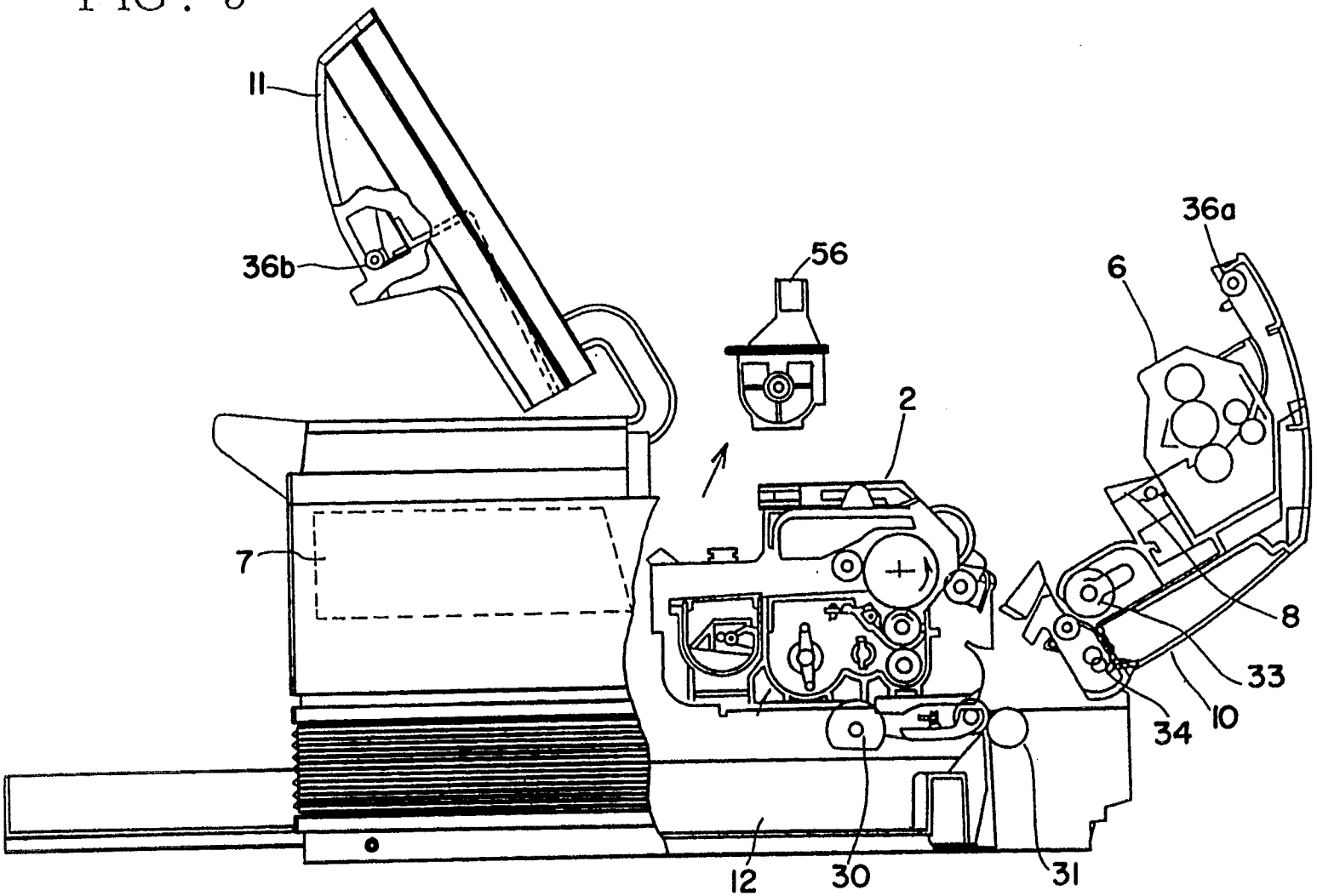
FIG. 5 is a diagram illustrating the image forming apparatus in FIG. 3 with its covers open.
Figure 6A:
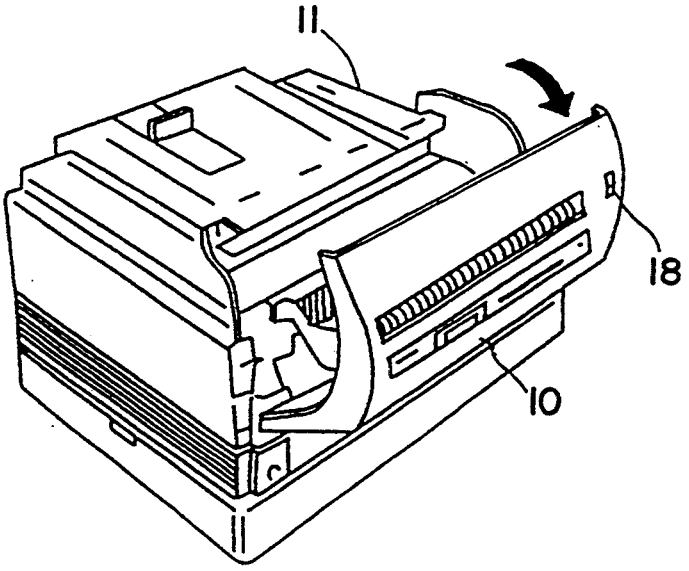
FIGS. 6A and 6B are diagrams illustrating the image forming apparatus shown in FIG. 2 with the covers open.
Figure 6B:
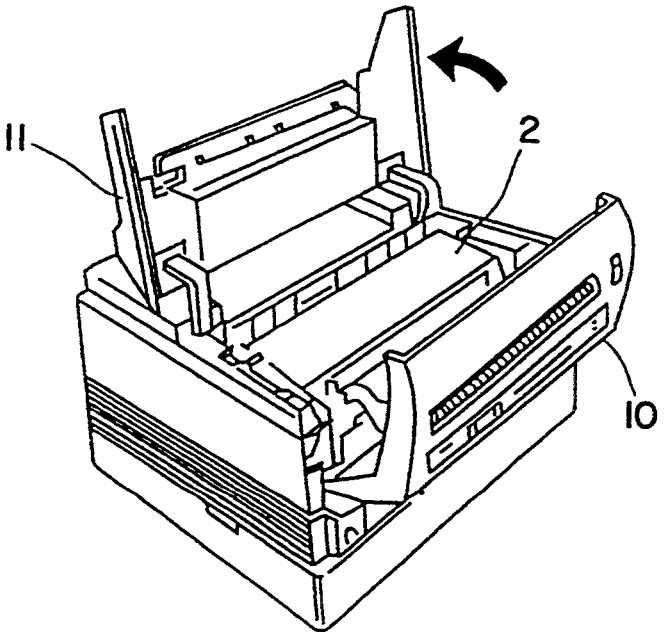

FIG. 2 is a perspective view showing the outline of an image forming apparatus according to one embodiment of the present invention, FIG. 3 is a cross-sectional view showing the interior of the image forming apparatus shown in FIG. 2, FIG. 4 presents a cross section of a process cartridge shown in FIG. 3, FIG. 5 illustrates the image forming apparatus in FIG. 3 with its covers open, FIG. 6A is a perspective view of the image forming apparatus with its front cover open, and FIG. 6B is a perspective view of the image forming apparatus with its upper cover open.

The illustrated image forming apparatus is an electrophotographic printer; FIG. 2 is a perspective view of the apparatus as viewed from the front. In FIG. 2, a front cover 10 is opened frontward of the apparatus to open a feeding path 3 shown in FIG. 3. An upper cover 11 covers the top of the apparatus, and is opened upward of the apparatus. When opened, the upper cover 11 opens the top of the apparatus. A sheet cassette 12 is to be set in the apparatus from the front thereof through a cassette inserting port 13. A stacker 14 is provided at the top of the apparatus to receive printed sheets. A sheet guide 15 is provided on the stacker 14 to guide the sheet discharged on the stacker. An operation panel 16 is provided at a front cover 10 and has various switches and a display unit. A controller box 17 is provided at the bottom of the apparatus and accommodates printer control circuits, etc.

Referring to the cross-sectional view in FIG. 3, an electrophotographic process cartridge 2 is provided above the sheet cassette 12 and will be described later with reference to FIG. 4. A thermal fixing unit 6 causes a sheet to be put through between a heat roller 60 and a backup roller 61 to fix a toner image on that sheet. This thermal fixing unit 6 is provided with a cleaning roller 62 for removing a toner from the heat roller 60. An optical unit 7 uses a polygon mirror to scan the photosensitive drum 40 with a beam from a semiconductor laser, which is driven according to image information, thereby writing an image on the photosensitive drum 40. The light image from the optical unit 7 passes above a developing unit 5 (which will be described referring to FIG. 4) of the process cartridge 2 as indicated by a broken-lined arrow to irradiate the photosensitive drum 40 of the process cartridge 2. A sheet separator 8 has a discharge electrode to apply charges of the opposite polarity to that of the potential at the back of the sheet on which the toner image on the photosensitive drum 40 has been transferred, to that back of the sheet to deelectrify the back of the sheet. This discharge electrode deelectrifies the back of the sheet to separate the sheet from the photosensitive drum 40.

A pickup roller 30 serves to pick up sheets in the sheet cassette 12. A resist roller 31 aligns the leading edge of the sheet picked up by the pickup roller 30, and feeds out the sheet. Reference numeral "32" denotes a manual-insertion guide which guides a manually inserted sheet to a feed roller 33 when opened rightward in FIG. 4. The feed roller 33 feeds the sheet, guided by the manual-insertion guide 32, toward the photosensitive drum 40 of the process cartridge 2. Reference numeral "34" is the rotary shaft of the front cover 10. Discharge rollers 36 are provided at the top portion of the front cover 10 to discharge the sheet, passing through the thermal fixing unit 6, onto the stacker 14.

As shown in the cross-section view in FIG. 4, the process cartridge 2 comprises a drum cartridge 4 and the developing unit 5. The developing unit 5 is attached to the drum cartridge 4 by pins (not shown), and can be separated therefrom by detaching the pins.

The structure of the drum cartridge 4 will now be described. In FIG. 4, the photosensitive drum 40 has an organic photosensitive layer (OPC or the like) formed on the surface of a cylindrical base of aluminum or the like, and is rotatable counterclockwise as shown. A brush charger 41 is constituted by winding a conductive brush, which has conductive rayon fibers woven into the core, around the rotary shaft. The photosensitive drum 40 is uniformly charged to about −600 V by this brush charger 41. A transfer roller is provided at the drum cartridge 4, and is made of a conductive porous rubber material, such as porous polyurethane foam (sponge). This transfer roller 42 is applied with a transfer voltage and is pressed against the photosensitive drum 40 to transfer the toner image on the photosensitive drum 40 onto the sheet. A waste toner box 43 (cleaner) is provided with a scraping blade 44, which scrapes the residue toner off the photosensitive drum 40, so that the box 43 receives the scraped toner. A handle 45 is provided to permit a user to carrying the drum cartridge 4 with a hand. A roller cover 46 serves to be a stopper for the transfer roller 42 and to protect the transfer roller 42.

The structure of the developing unit 5 will be described next. Referring to FIG. 4, a developing roller 50 is a conductive elastic roller, which is preferably made of a conductive porous rubber material, such as conductive porous polyurethane foam (sponge). The developing roller 50 rotates clockwise as shown in the diagram to feed a non-magnetic, one-component toner to the photosensitive drum 40 while holding the toner with the retentive force of its surface. This developing roller 50 is pressed against the photosensitive drum 50 with a predetermined nip width and is applied with a developing bias voltage of about −300 V. A layer-thickness restricting blade 51, which is made of a 0.1-mm thick stainless plate, serves to restrict the thickness of the toner layer on the developing roller 50 to a predetermined thickness. This layer-thickness restricting blade 51 is pressed against the developing roller 50 and is applied with a negative voltage of about −400 V. This applied voltage allows the layer-thickness restricting blade 51 to supply negative charges to the toner to forcibly charge the toner negatively at the time of restricting the thickness of the toner layer. Accordingly, the toner can be charged stably even under the conditions of high humidity and high temperature. A reset roller 52 is disposed to face the developing roller 50 and rotates in the same direction as the developing roller 50. This reset roller 52 is applied with a bias voltage of −400 V to scrape the toner off the developing roller 50 in the right-hand side of the diagram and supply the toner to the developing roller 50 in the left-hand side of the diagram.

Reference numerals "53" and "54" denote paddle rollers, which rotate to stir the non-magnetic, one-component toner in the developing unit 5 and charge the toner. In addition, the paddle rollers 53 and 54 supply the stirred toner toward the reset roller 52. A toner cassette retainer 55 retains a toner cassette 56, which contains the non-magnetic, one-component toner. This toner cassette 56 is detachably set in the toner cassette retainer 55. A toner supply lever 57 is provided in the toner cassette 56, and rotates to feed the toner in the toner cassette 56 into the developing unit 5. The toner cassette 56 is provided with a handle 58 to allow a user to hold the toner cassette 56 with a hand. A sheet guide rib 59 is provided below the roller cover 46. This sheet guide rib 59, together with the roller cover 46, forms a path for guiding the sheet between the photosensitive drum 40 and the transfer roller 42.

A U-shaped feeding path 3 is formed, which extends from the sheet cassette 12 and reaches the discharge rollers 36 through the process cartridge 2.

The function of this printer will be described referring to FIGS. 2 through 4. A sheet in the sheet cassette 12 is picked up by the pickup roller 30 and abuts against the resist roller 31. After the leading edge is aligned by the resist roller 31, this sheet is fed toward the photosensitive drum 40 along a U-shaped feeding path 3. Meantime, when the picked sheet reaches the resist roller 31, the optical unit 7 starts exposing the photosensitive drum 40 to image light. As a result, the potential of the image-exposed portion of the photosensitive drum 40, which has been charged to −600 V by the brush charger 41 becomes zero, thus forming an electrostatic latent image corresponding to the image to be copied.

As a bias voltage of −300 V is applied to the developing roller 50 in the developing unit 5, the negatively charged toner sticks on the image-exposed portion of zero potential of the photosensitive drum 40, forming a toner image thereon. The toner image on the photosensitive drum 40 is transferred onto the sheet, fed by the resist roller 31, by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is fed to the thermal fixing unit 6 where the toner image on the sheet is thermally fixed by the heat roller 60. The image-fixed sheet is then discharged on the stacker 14 by the discharge rollers 36.

A sheet manually inserted through the manual-insertion guide 32 pulled open is likewise conveyed toward the photosensitive drum 40 by the feed roller 33. The toner image on the photosensitive drum 40 is transferred onto that sheet by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is then fed to the thermal fixing unit 6 where the toner image on the sheet is thermally fixed by the heat roller 60. The resultant sheet is then discharged on the stacker 14 by the discharge rollers 36.

In the diagram of FIG. 5 which illustrates the front cover and upper cover of the apparatus opened, the front cover 10 is opened frontward (rightward in the diagram) around the cover rotary shaft 34. Provided on this front cover 10 are the manual-insertion guide 32, the feed roller 33, the sheet separator 8, the thermal fixing unit 6 and an upper discharge (drive) roller 36*a* of the discharge roller pair 36. The upper cover 11 is opened upward of the apparatus (upward in the diagram) around a rotary shaft (not shown). A lower discharge (pinch) roller 36*b* of the discharge roller pair 36 is provided on the upper cover 11.

When the front cover 10 is opened by unlocking a lock lever 18 of the front cover 10, as shown in FIGS. 5 and 6A, the U-shaped feeding path 3 extending from the resist roller 31 to the discharge rollers 36 is opened, making it easier to remove any jammed sheet. If the transfer roller 42 is shifted from the proper position facing the photosensitive drum 40, i.e., if there is a shift in parallelism and position to the photosensitive drum 40, image transfer cannot be executed properly. In this respect, the transfer roller 42 is provided on the process cartridge 2. Although this design does not open the space between the photosensitive drum 40 and the transfer roller 42, a jammed sheet can easily be removed without any problem even if that portion does not become free.

The reason why the whole thermal fixing unit 6 is provided on the front cover 10 is that if the thermal fixing unit 6 were divided to open the feeding path, a part of the thermal fixing unit 6 should be provided on the process cartridge 2, thus inconveniencing a user to remove the process cartridge 2. Although this design does not open the space between the heat roller 60 of the thermal fixing unit 6 and the backup roller 61, a jammed sheet can easily be removed without any problem even if that portion does not become free.

The front cover 10 is provided above the upper cover 11 at the sheet discharging portion so that the upper cover 11 does not become free unless the front cover 10 is opened as shown in FIG. 2. When the front cover 10 is opened and the upper cover 11 is opened next as shown in FIG. 6B, therefore, the top portion of the apparatus and part of the front portion of the apparatus are opened as shown in FIG. 5. Accordingly, the toner cassette 56 can easily be removed or attached from the front side of the apparatus while keeping the process cartridge 2 installed in the apparatus, thus allowing for the exchange of the toner cassette 56 alone.

As the front side of the apparatus is opened by opening the front cover 10 and the top portion of the apparatus is opened by opening the upper cover 11 as shown in FIG. 5, the attachment and detachment of the process cartridge 2 can also be performed easily. Even if the process cartridge 2 is large, therefore, the exchange of the process cartridge 2 is easy. In other words, the process cartridge 2 can be designed large, particularly, the developing unit 5 in the process cartridge 2 can be designed large, so that the quantity of the retainable developer can be increased, thus making the exchanging cycle of the developing unit 5 significantly long.

Further, since the developer can be supplemented through the exchange of the toner cassette 56 alone, the exchanging cycle of the developing unit 5 can be made longer. Furthermore, as the covers 10 and 11 are opened with the discharge rollers 36 separated into upper and lower rollers, the entire U-shaped feeding path 3 can be opened, thus facilitating removal of a jammed sheet.

Figure 7:
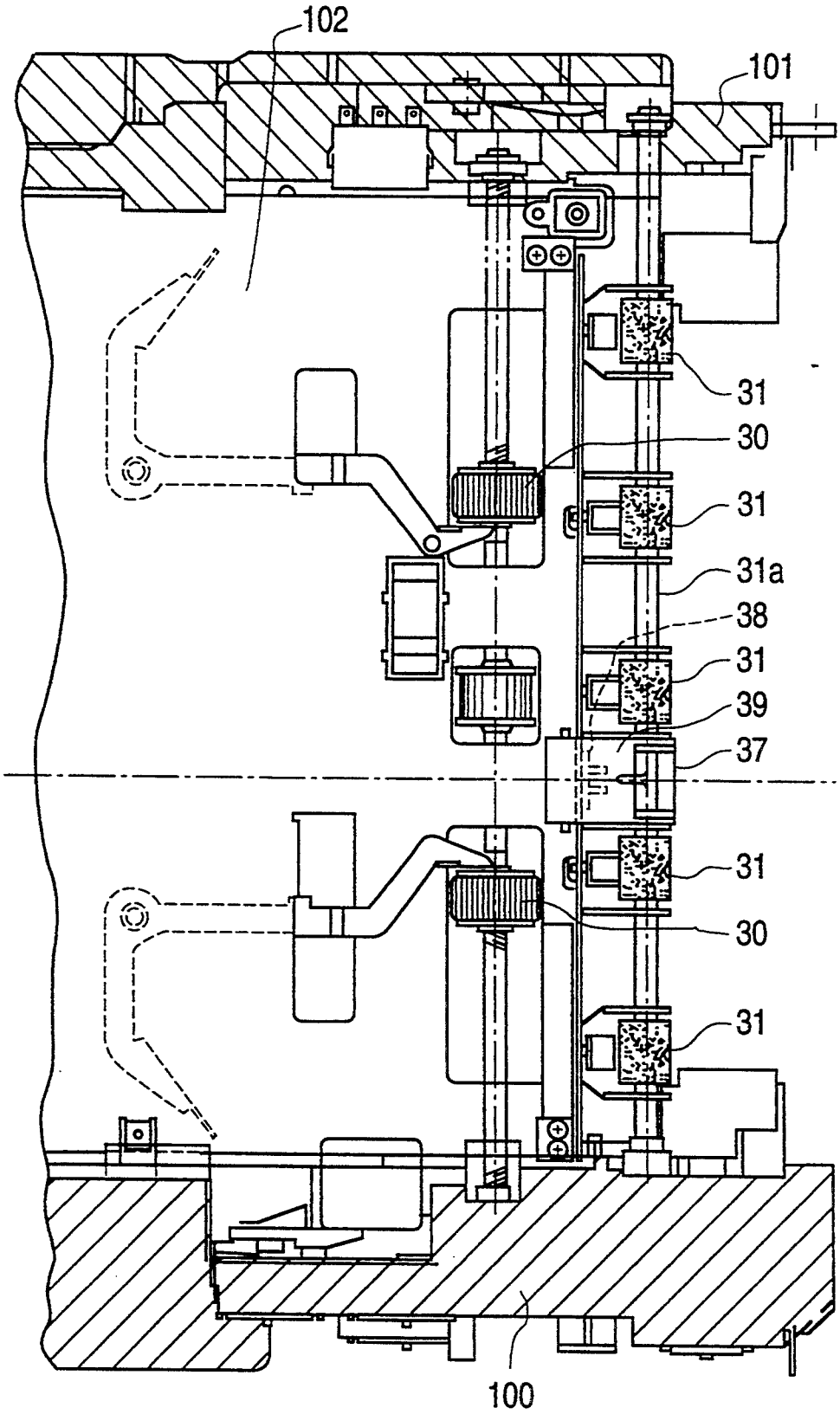
FIG. 7 is a top view of a pickup mechanism shown in FIG. 3.
Figure 8:
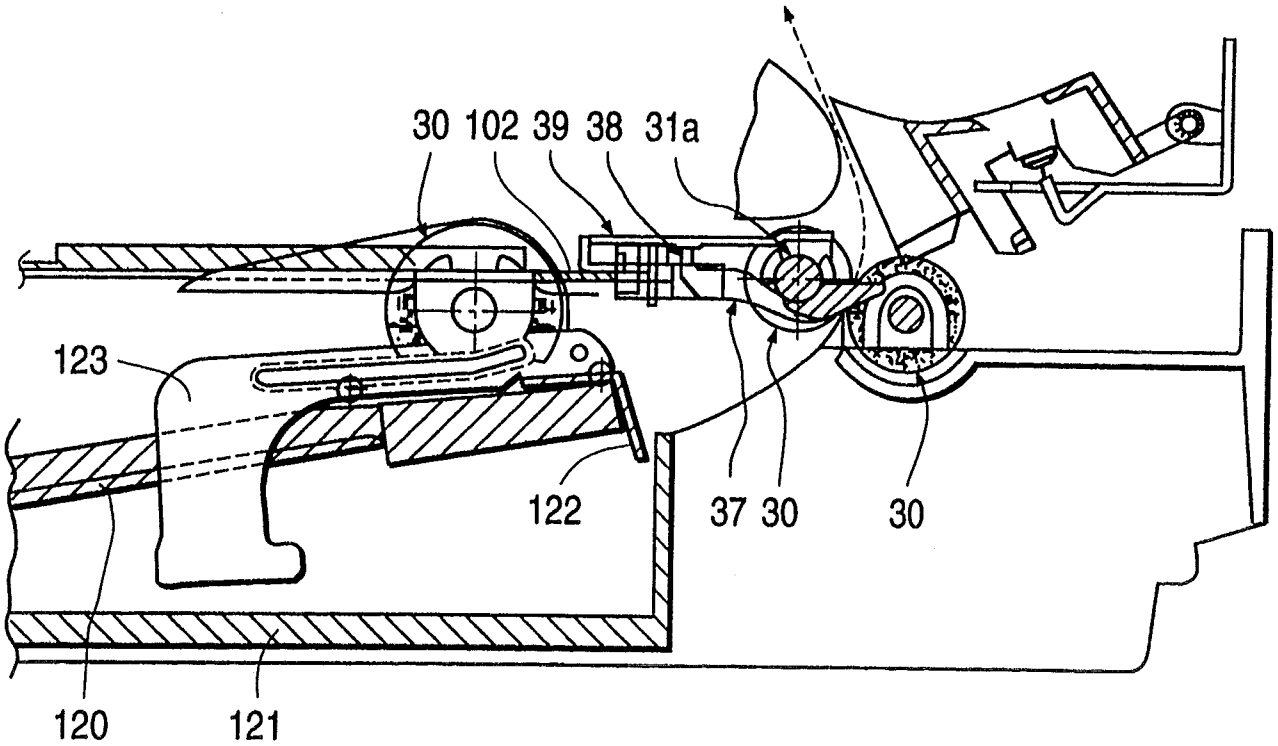
FIG. 8 is a cross-sectional view of the a pickup mechanism in FIG. 7.
Figure 9:
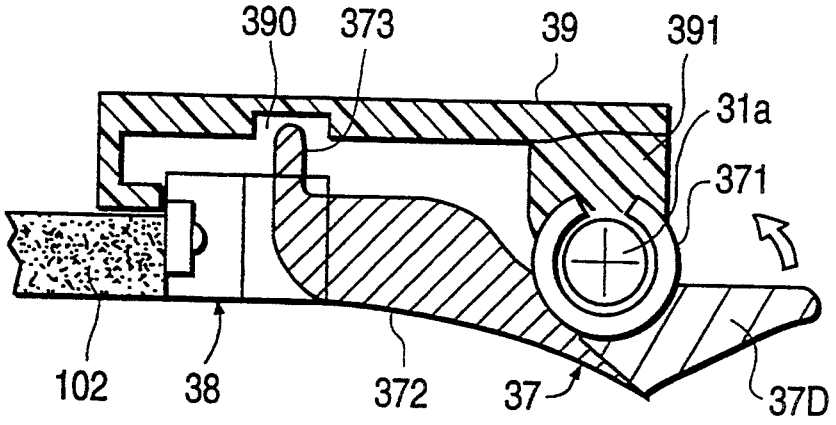
FIG. 9 is a cross-sectional view of a sheet detecting mechanism shown in FIG. 8.
Figure 10:
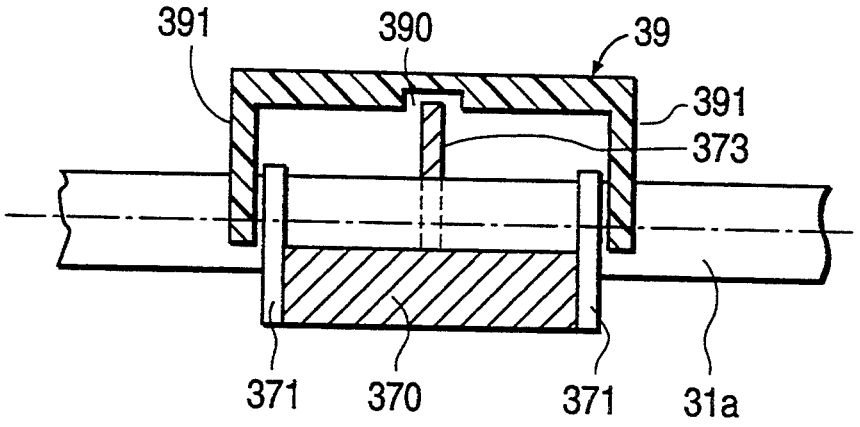
FIG. 10 is a side view of the sheet detecting mechanism shown in FIG. 9.
Figure 12:
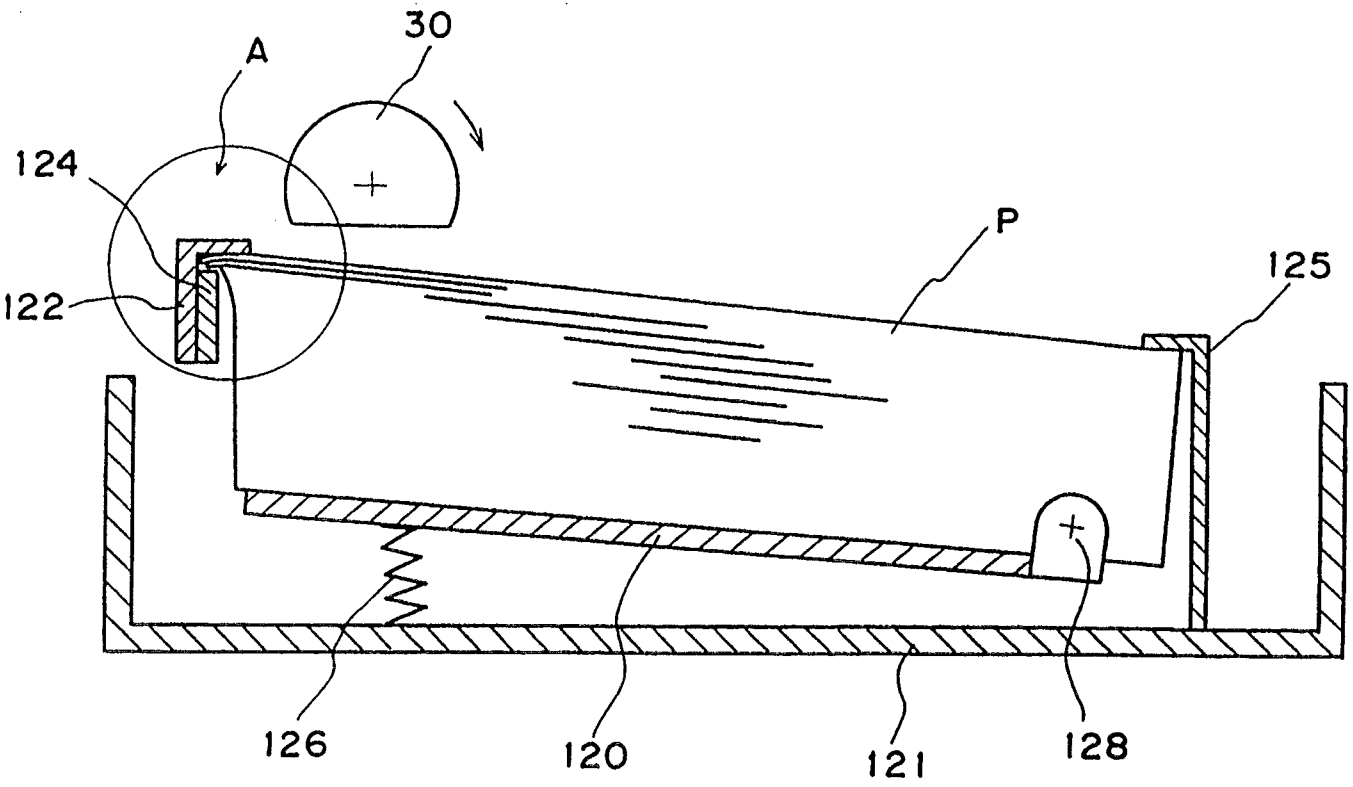
FIG. 12 is a cross-sectional view of a sheet cassette shown in FIG. 8.

FIG. 7 is a top view of a pickup mechanism, FIG. 8 is a cross-sectional view of the pickup mechanism, FIG. 9 is a cross-sectional view of a sheet detecting mechanism, FIG. 10 is a side view of the sheet detecting mechanism, and FIG. 12 is a top view of the sheet detecting mechanism.

As shown in FIG. 7, a pickup shaft 30*a* is provided between a right frame 100 and a left frame 101 of the apparatus, with three pickup rollers 30 provided on the pickup shaft 30*a*. Likewise, a resist shaft 31*a* is provided on the right side (on the side of the sheet feeding direction) with five resist rollers 31 provided on the resist shaft 31*a*. The pickup shaft 30*a* and resist shaft 31*a* are respectively driven by a pickup motor 112 and a resist motor 116 (which will be described later referring to FIG. 17). Provided between the right and left frames 100 and 101 is a main stay 102 that covers the sheet cassette 12. A sensor lever 37 of a sheet detecting mechanism is fitted on the center of the resist shaft 31*a* of the resist rollers 31. A transmission photosensor 38 for detecting this sensor lever 37 is secured to the main stay 102 by screws.

As shown in FIG. 8, the cover 39 is provided over the transmission photosensor 38 to prevent foreign matter from entering the transmission photosensor 38. The sheet cassette 12 is disposed below the pickup roller 30. This sheet cassette 12 has a cassette case 121, a bottom plate 120 for holding sheets, a hold lever 123 provided on a side plate (not shown) of the cassette case 121, and a front stopper 122 provided at the distal end of the hold lever 123. The sensor lever 37 protrudes into a feeding path between the resist roller pair 30.

Figure 11:
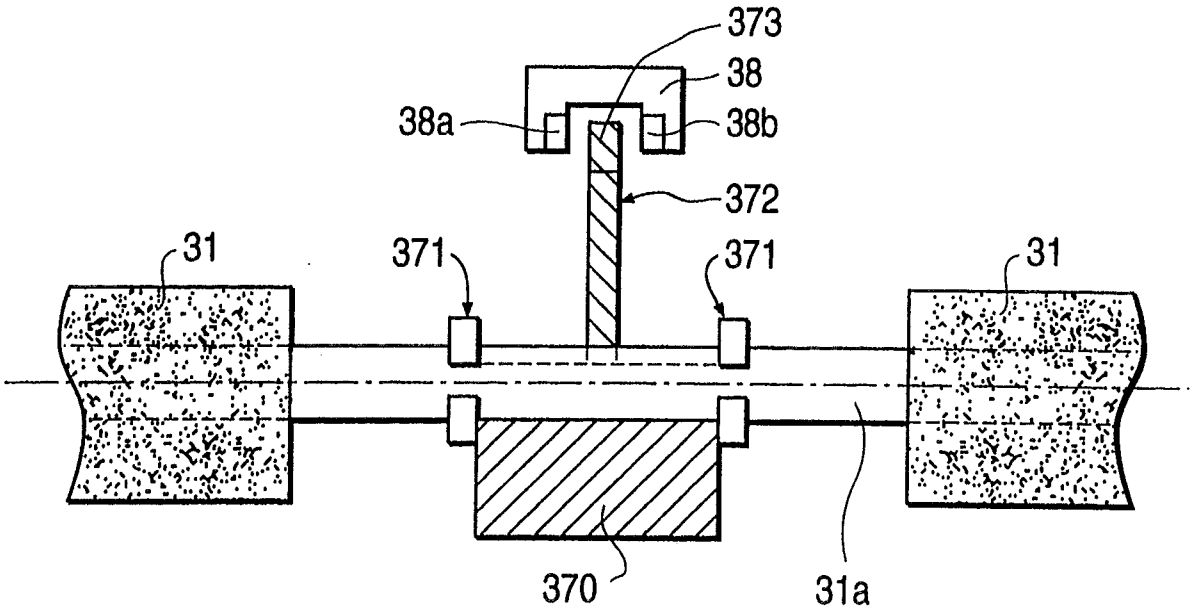
FIG. 11 is a top view of the sheet detecting mechanism shown in FIG. 9.

The sheet detecting mechanism will now be described referring to FIGS. 9, 10 and 11. As shown in FIGS. 9 to 11, the sensor lever 37 has a projection 370 protruding frontward of the resist rollers 31, fitting portions 371 provided on both sides of the projection 370, and a detection bar 372 linked to the projection 370. The end portion 373 of the detection bar 372 faces upward.

The transmission photosensor 38 has a light-emitting element 38*a* and a light-receiving element 38*b* facing each other as shown in FIG. 11. The transmission photosensor 38 is attached to the main stay 102 as shown in FIG. 9. As shown in FIG. 11, the detection bar 372 comes between the light-emitting element 38*a* and light-receiving element 38*b* of the photosensor 38. As shown in FIGS. 9 and 10, the cover 39 is provided over the transmission photosensor 38 and the detection bar 372 of the sensor lever 37. This cover 39 has fitting portions 391 provided on both sides, and has its one end secured to the resist shaft 31*a* of the resist rollers 31 with the fitting portions 391 fitted on the resist shaft 31*a*. The other end of the cover 39 is securely fitted on the main stay 102.

This cover 39 has a slit 390 where an end portion 373 of the detection bar 372 of the sensor lever 37 is positioned. This end portion 373 abuts on the slit 390 of the cover 39 so that the cover 39 becomes a stopper to stop the clockwise rotation of the sensor lever 37. As shown in FIG. 10, the rightward and leftward movements of the end portion 373 in the diagram are restricted by the slit 390. This accomplishes the positioning of the sensor lever 37 along the resist shaft 31*a*, so that the detection bar 372 of the sensor lever 37 is positioned between the light-emitting element 38*a* and light-receiving element 38*b* of the photosensor 38.

The fitting portions 391 of the cover 39 also restrict the position of the sensor lever 37 along the resist shaft 31*a*, as shown in FIG. 10.

The function of this sheet detecting mechanism will now be described. As the projection 370 of the sensor lever 37 is heavier than the detection bar 372, the sensor lever 37 receives clockwise rotational force around the resist shaft 31*a*. Accordingly, the end portion 373 of the detection bar 372 is positioned at the slit 390 of the cover 39, abutting on the cover 39, as shown in FIG. 9. At this time, the detection bar 372 lies between the light-emitting element 38*a* and light-receiving element 38*b* of the transmission photosensor 38, thus ensuring the generation of an output representing that no sheet has been detected.

The projection 370 of the sensor lever 37 is located in front of the resist rollers 31 due to its dead weight. Therefore, the picked sheet abuts against the projection 370 of the sensor lever before abutting on the resist rollers 31. As the sensor lever 37 is rotatable around the resist shaft 31*a* by the fitting portions 371, it is lifted up in the direction of the arrow in FIG. 9 by the sheet being conveyed. After lifting the sensor lever 37 up, the sheet abuts against the resist rollers 31.

When not detecting a sheet, the detection bar 372 of the sensor lever 37 shields the transmission photosensor 38 from light. When the sheet lifts up the projection 370, the sensor lever 37 rotates counterclockwise around the resist shaft 31*a*. This causes the detection bar 372 to release the light shielding of the photosensor 38. As a result, the photosensor 38 changes its output, thus generating a sheet detection signal. After the trailing edge of the sheet passes the sensor lever 37 and the sensor lever 37 does not engage with the sheet, the sensor lever 37 rotates clockwise due to the dead weight to return to the initial position.

With the use of such a sheet detecting mechanism, even the mechanical sensor can detect before the resist rollers 31 that the pickup of a sheet because it uses the resist shaft 31*a* as its own shaft. Since this structure needs no extra mechanism in the sheet-slacking space between the pickup roller 30 and resist rollers 31, it will not interfere with the sheet feeding and sheet slacking, and can prevent sheet jamming and the deformation of sheet slacking, thus ensuring smooth sheet pickup.

As the non-contact type photosensor 38 is used to detect the sensor lever 37, it will not become a rotational load on the sensor lever 37. Further, since the photosensor 38 will not be a load on sheet feeding, thus ensuring stable sheet detection. As the cover 39 is provided, it can prevent foreign matter, such as sheet powder or a developer, from sticking on the photosensor 38, ensuring stable detection. What is more, as the cover 39 serves both as a stopper for the sensor lever 37 and as means to position the sensor lever 37 along the shaft, a small sheet sensor can be realized.

Figure 13:
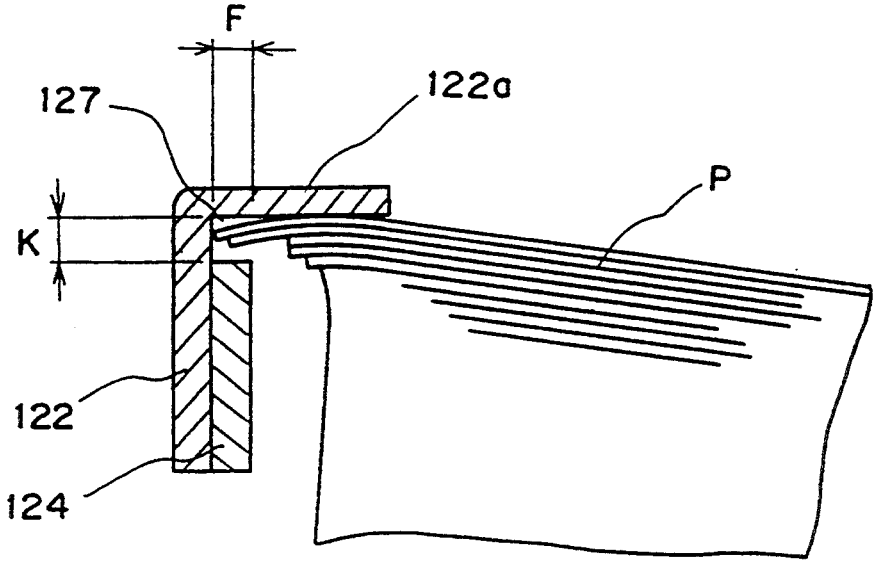
FIG. 13 is an enlarged diagram showing a portion A in FIG. 12.
Figure 14:
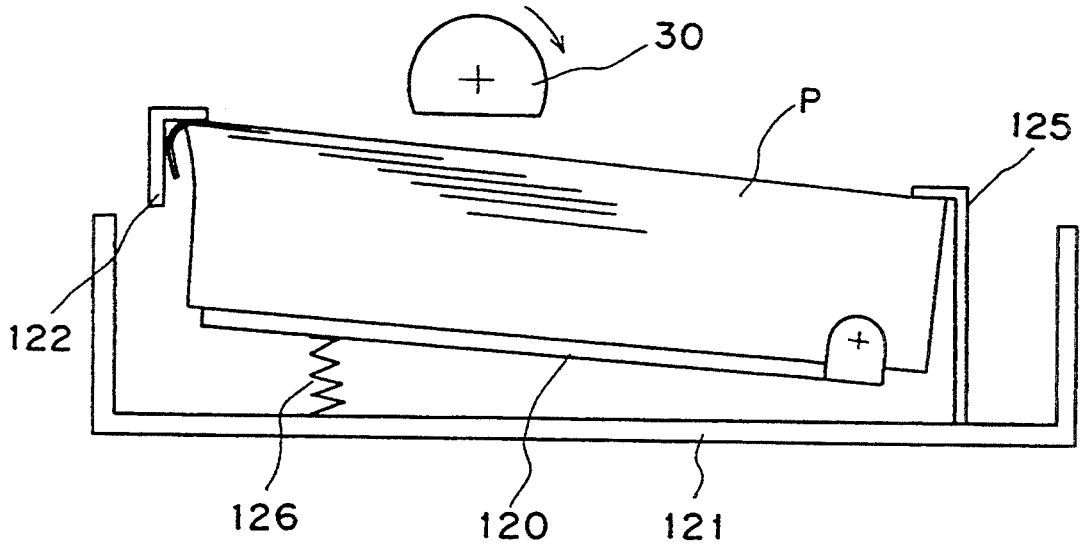
FIG. 14 is a diagram for explaining the problem of a conventional sheet cassette.
Figure 15:
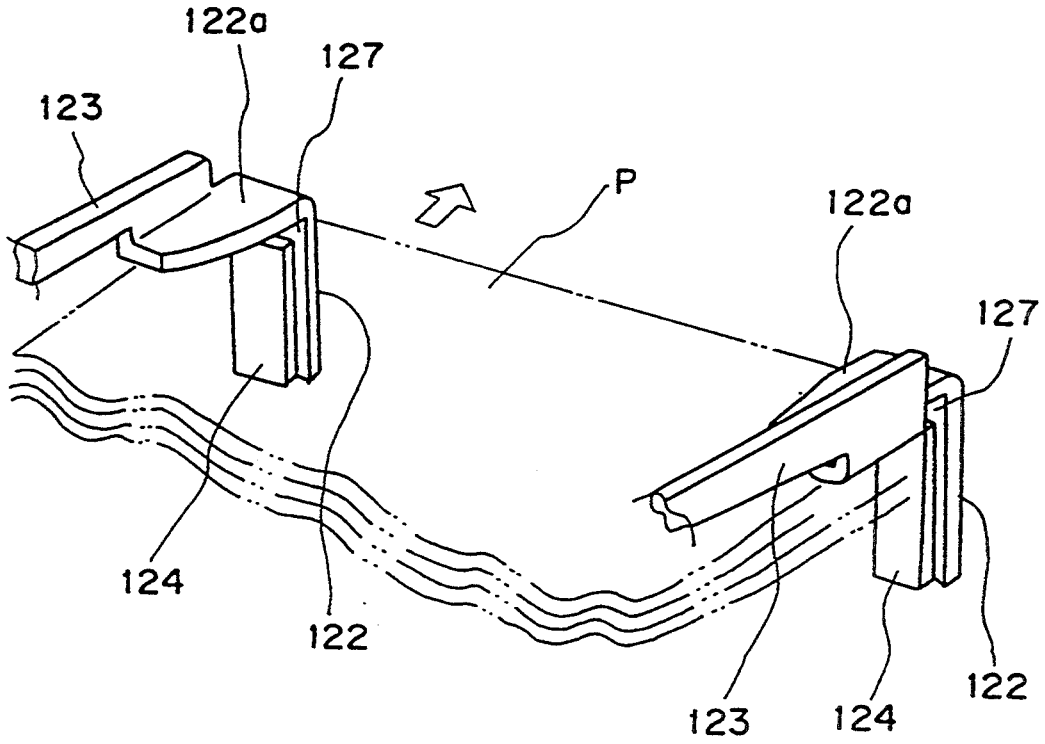
FIG. 15 is a diagram for explaining a modification of the sheet cassette.
Figure 16:
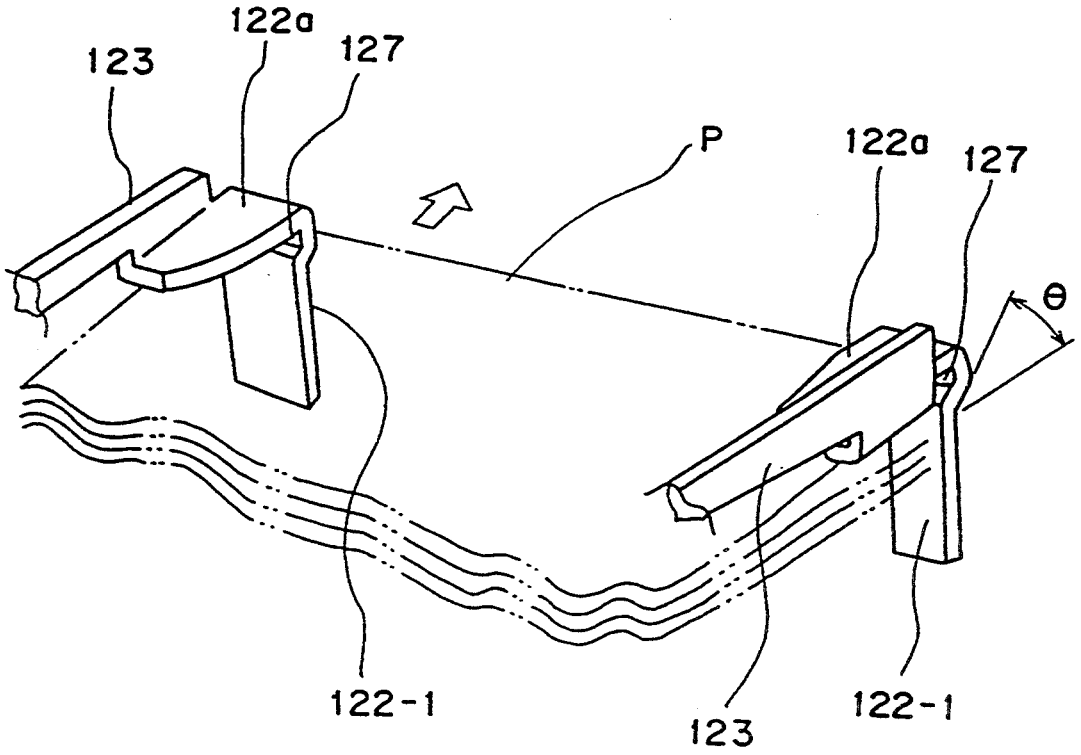
FIG. 16 is a diagram for explaining another modification of the sheet cassette.

FIG. 12 is a cross-sectional view of the sheet cassette shown in FIG. 8, FIG. 13 is an enlarged diagram showing a portion A in FIG. 12, FIG. 14 is a diagram for explaining the problem which is to be overcome by the sheet cassette shown in FIG. 12, FIG. 15 is a perspective view of the portion A in FIG. 13, and FIG. 16 is a diagram showing a modification.

FIG. 12 shows the sheet cassette 12 in FIG. 8 the left side right. As shown in FIG. 12, the cassette case 121 is provided with a rear stopper 125. The bottom plate 120 of the cassette is attached to the side plate of the cassette case 121 by a rotational shaft 128. A spring 126 is provided on the left-hand portion of the cassette case 121 to urge the bottom plate 120 clockwise around the rotational shaft 128. The leading edges of the sheets P on the bottom plate 120 abut against the front stopper 122.

As shown in FIGS. 13 and 15, the stopper 122 has a shape of an inverted L, and has a horizontal portion 122*a* functioning as a pawl and a vertical portion which is a sheet abutting face. A plate 124 is welded or adhered to the sheet abutting face of the stopper 122. This plate 124 is provided in such a way as to form a recess 127 between itself and the separation pawl 122*a*.

The reason why this recess 127 is provided will be explained below. FIG. 14 shows a sheet cassette which has no recess 127 provided on the stopper 122. As shown in FIG. 14, as the pickup roller 30 rotates, the topmost sheet among the sheets on the bottom plate 120 is separated by the separation pawl 122*a* and is fed leftward in the diagram. As illustrated, the interval between the front stopper 122 and the rear stopper 125 is set larger than the size of the sheets. This is because the bottom plate 120 tilts every time the sheet P is fed out, so that unless interval between the front stopper 122 and the rear stopper 125 is set larger than the size of the sheets, the proper sheet feeding is difficult. Further, sheets to be set do not have a constant size due to a variation in sheet size for each type of sheets and the possible shrinkage/stretching originating from the environmental conditions, such as temperature and humidity. The larger interval between both stoppers 122 and 125 also serves to cope with such variation and shrinkage/stretching.

As the interval between the stoppers 122 and 125 is set larger than the size of the sheets, the upper sheets among those on the bottom plate 120 abut against the sheet abutting face of the front stopper 122 as the sheet feeding takes place. Sheet feeding in this condition raises no problem if the sheets are woodfree paper having high stiffness. If sheets in use are so-called soft sheets having low stiffness, such as thin sheets or recycled sheets, one or more than one sheet at the topmost portion of the sheets on the bottom plate 120 may enter the clearance between the leading edge portion of the underlying sheets and the stopper 122 as the sheet feeding takes place by the rotation of the pickup roller 30. This situation is illustrated in FIG. 14.

When this situation occurs, sheet feeding from the sheet cassette 12 cannot continue. To overcome this problem, the recess 127 is provided on the stopper 122 as shown in FIG. 13. Even if one or more than one sheet at the topmost portion of the sheets on the bottom plate 120 are fed out in accordance with the sheet feeding initiated by the rotation of the pickup roller 30, the leading edges of the sheets are held in the recess 127. It is there fore possible to prevent the fed-out sheets from entering the clearance between the leading edge portion of the underlying sheets and the stopper 122.

The length of the recess 127, K, in the thickness direction of sheets as shown in FIG. 13 is preferably 0.5 mm, and the thickness of the plate 124 is 1 mm.

FIG. 16 illustrates the recess 127 provided by a bending work. That is, the recess 127 is formed by bending the front stopper 122. At this time, the bending angle i is preferably 0 to 60 degrees. Alternatively, the recess 127 may be formed by well-known drawing.

Figure 17:
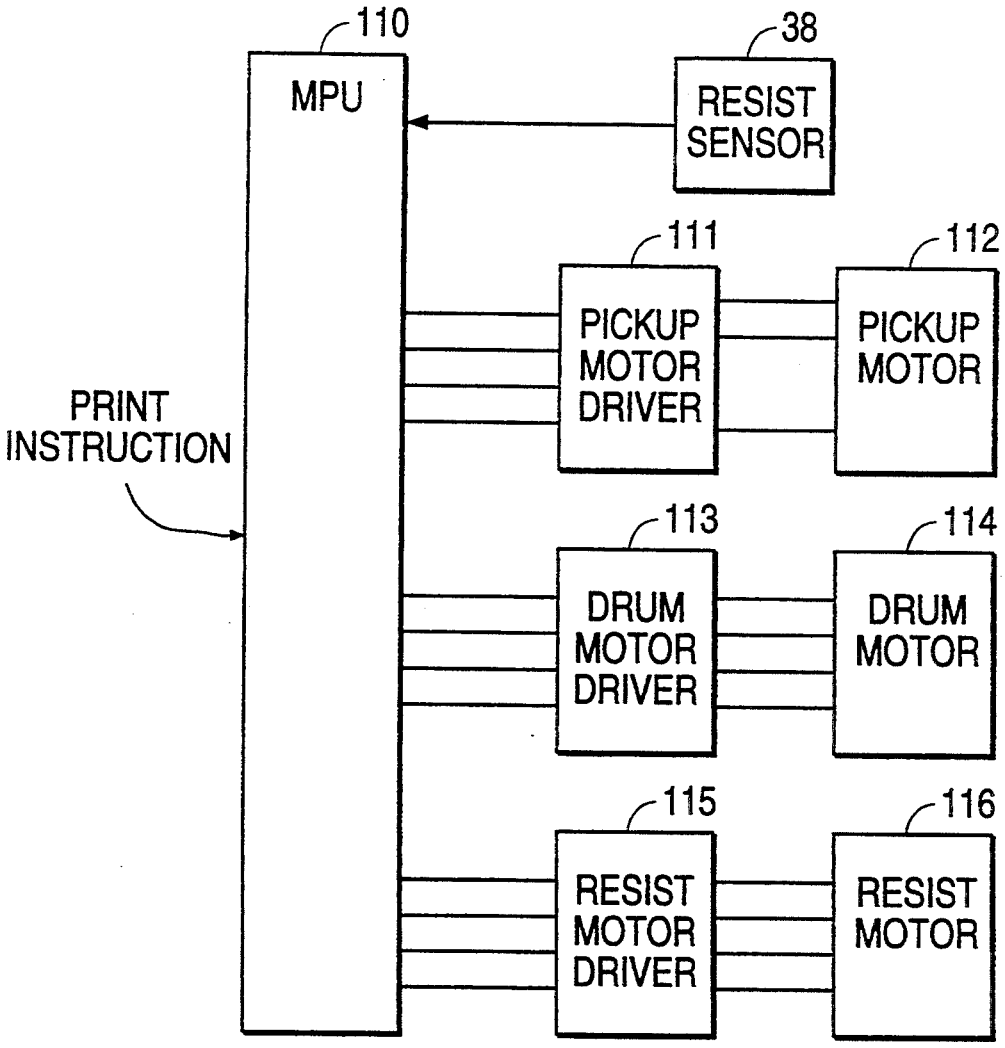
FIG. 17 is a control block diagram.
Figure 18:
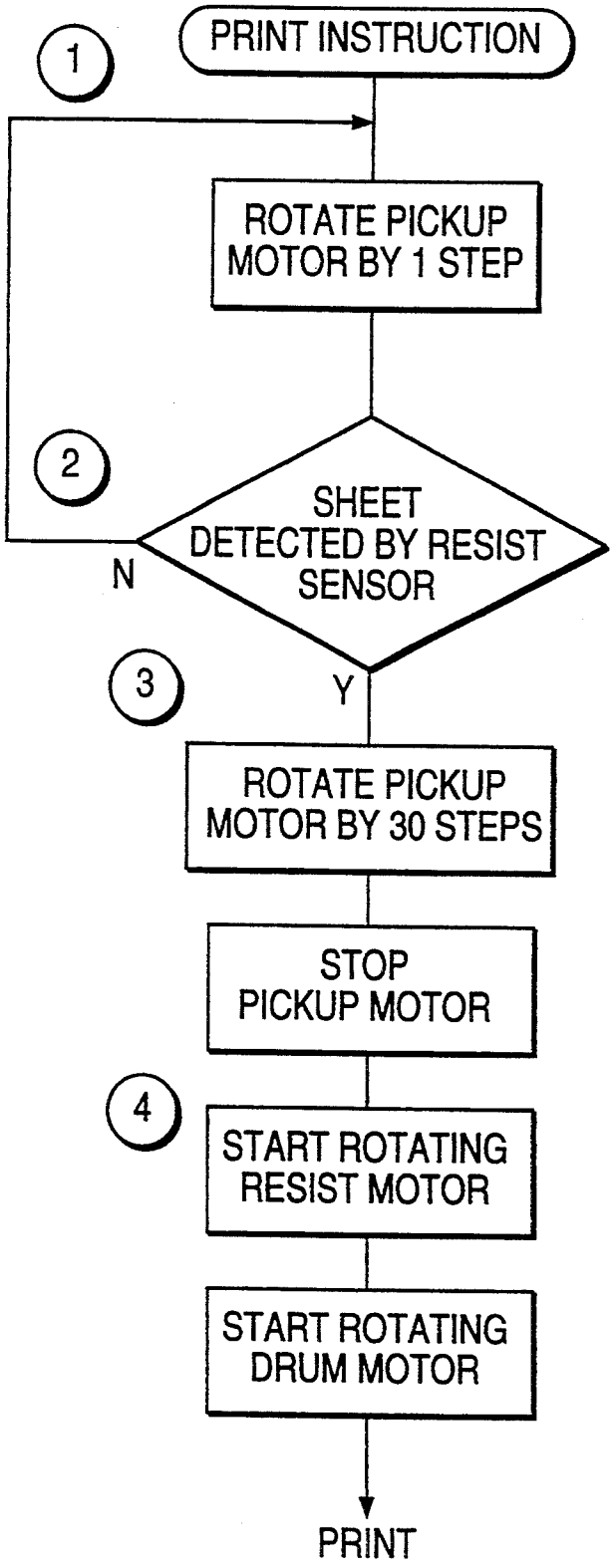
FIG. 18 is a flowchart illustrating the process of the structure shown in FIG. 17.
Figure 19:
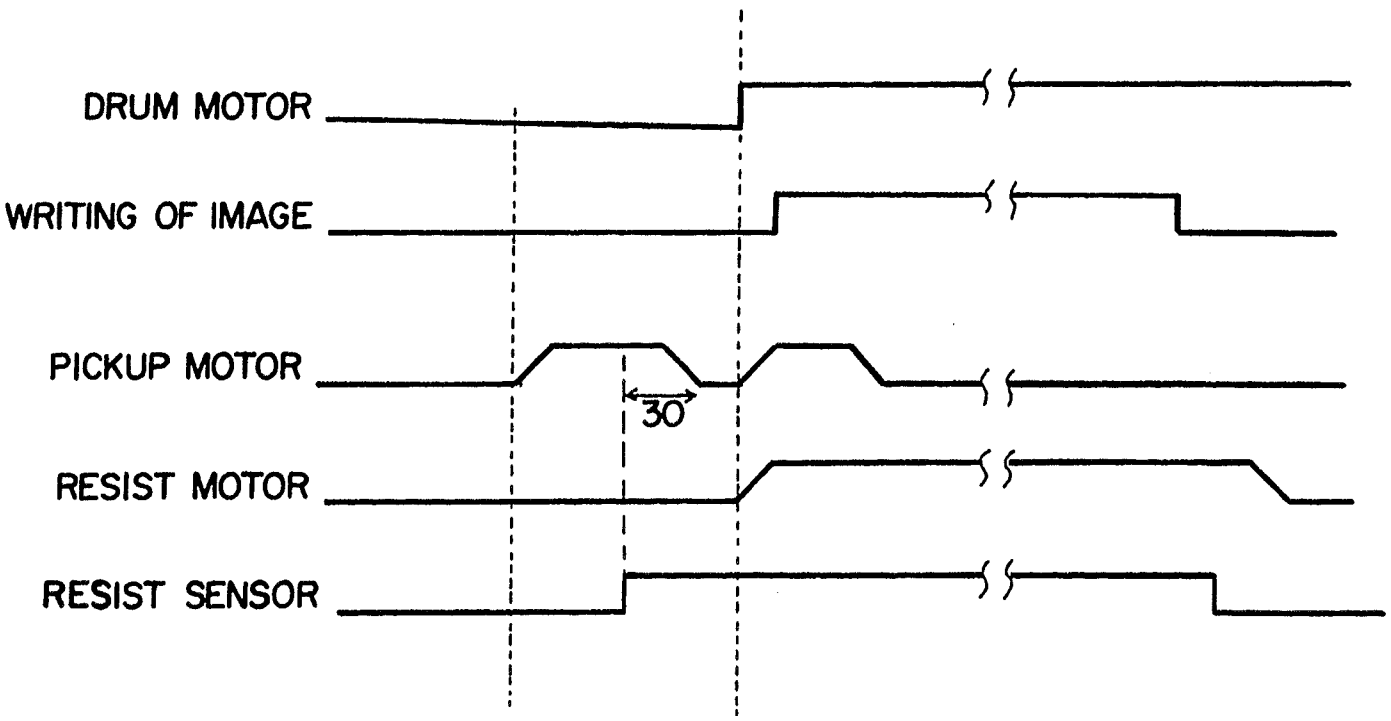
FIG. 19 is a time chart of the structure shown in FIG. 17.
Figure 20:
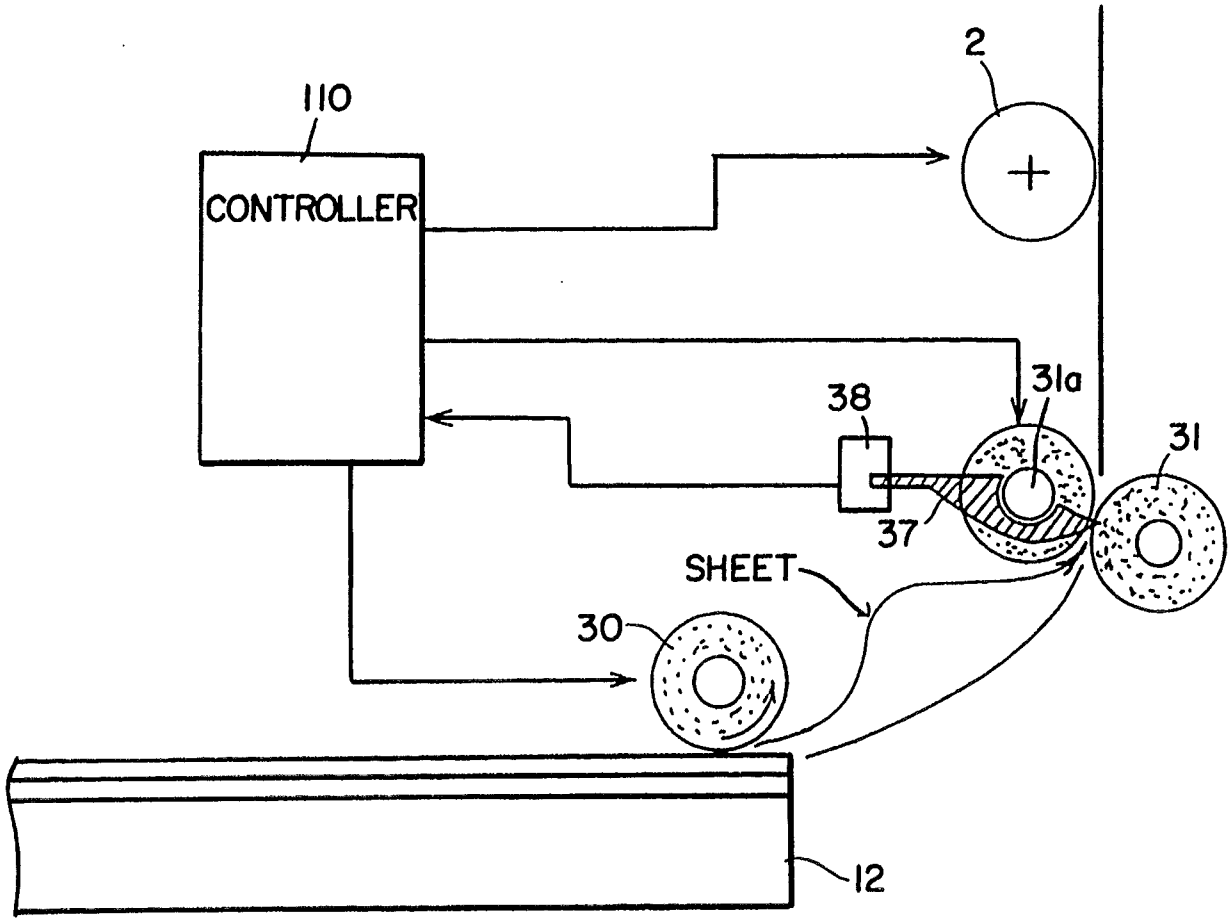
FIG. 20 is a diagram for explaining the operation of the structure shown in FIG. 17.

FIG. 17 is a control block diagram of the present invention, FIG. 18 presents a flowchart of this invention, FIG. 19 presents a time chart for this invention, and FIG. 20 is an explanatory diagram of the operation of this invention.

In FIG. 17, reference numeral "110" denotes a control circuit which is constituted of a microprocessor and controls the individual sections of the image forming apparatus upon reception of a print instruction. A pickup motor driver 111 drives a pickup motor 112 constituted of a stepping motor. The pickup motor 112 rotates the pickup roller 30. A drum motor driver 113 drives a drum motor 114 constituted of a stepping motor. The drum motor 114 rotates the photosensitive drum 40. A resist motor driver 115 drives a resist motor 116 constituted of a stepping motor. The resist motor 116 rotates the resist rollers 31.

The operation will now be described according to the flowchart in FIG. 18 and referring to the time chart in FIG. 19 and the operational diagram of FIG. 20.

(1) Upon reception of a print instruction, the control circuit (hereinafter called "processor") 110 causes the pickup motor driver 111 to rotate the pickup motor 112 by one step to thereby allow the pickup roller 30 to feed a sheet.

(2) After the one-step rotation of the pickup motor 112, the processor 110 reads the output of the photosensor 38 of the sheet detecting mechanism and determines if a sheet has been detected. When judging that no sheet has been detected, the processor 110 returns to step (1).

(3) When the output of the photosensor 38 indicates that the sheet has been detected, the leading edge of that sheet has reached the position of the sheet detecting mechanism immediately before the resist rollers 31. When determining that the sheet has been detected, the processor 110 causes the pickup motor drive 111 to rotate the pickup motor 112 by 30 steps to give the resist amount to the sheet. This allows the pickup roller 30 to perform a resist operation. In other words, the sheet abuts against the resist rollers 31 and is given a predetermined amount of slacking to correct skewing, as shown in FIG. 20. After the 30-step rotation, the processor 110 stops rotating the pickup motor 112.

(4) Then, the processor 110 causes the resist motor driver 115 to start rotating the resist motor 116, thus rotating the resist rollers 31. As a result, the skew-corrected sheet is fed toward the photosensitive drum 40. At the same time, the processor 110 causes the drum motor driver 113 to rotate the drum motor 114, thus rotating the photosensitive drum 40. Then, the processor 110 permits the optical unit 7 to start writing an image with a laser beam. Consequently, a toner image is formed on the photosensitive drum 40 as mentioned earlier, and the toner image is transferred on the fed sheet and thermally fixed thereon before being discharged on the stacker 14.

As the amount of the rotation of the pickup roller 30 is controlled by the sheet detection of the sheet detecting mechanism 37, 38 located before the resist rollers 31, the resist amount becomes constant, ensuring the skew correction. Further, the resist rollers 31 will not rotate unless the sheet detecting mechanism 37, 38 detects a sheet. Even if a pickup failure occurs, therefore, the resist rollers 31 will not rotate and wasteful driving thereof can be prevented.

Furthermore, an image forming operation, which starts with the rotation of the photosensitive drum 40, will not be initiated unless the sheet detecting mechanism 37, 38 detects a sheet. If a sheet does not arrive at the photosensitive drum 40 due to a pickup failure or the like, the image forming operation will not start, thus making the service life of the photosensitive drum 40, etc. longer.

The present invention is not limited to the above embodiment, but may be modified in various manners as follows. First, although the image forming apparatus has been explained as an electrophotographing apparatus, this invention may be applicable to other types of image forming apparatuses which form a toner image. Secondly, although a photosensor is used as the detection means, a micro switch, a proximity switch and so forth may be used as needed. Thirdly, although the image forming apparatus has been explained as a printer, it may be a different type of image forming apparatus, such as a copying machine or facsimile. Fourthly, the photosensitive body is not limited to a drum type, but may be of an endless type, such as an endless belt type. Further, the charging means is not limited to a charging roller, but may be a corotron or the like.

In short, according to the present invention, since the sheet detecting mechanism is provided before the resist rollers, the resist operation by the pickup roller can be executed after the pickup of a sheet is checked before the sheet reaches the resist rollers, thus ensuring skew correction. If the sheet detecting mechanism does not detect a sheet, the subsequent operation, such as the driving of the resist rollers, will not start, thus preventing a wasteful operation from being performed when the sheet does not arrive at where expected due to a pickup failure or the like. Further, since the sheet detecting mechanism is provided on the shaft of the resist rollers, sheet detection before the resist rollers can be accomplished by a mechanical sensor which stably functions with respect to foreign matter.

What is claimed is:

1. An image forming apparatus comprising:

a sheet retaining unit for retaining sheets;

a pickup roller for picking up a sheet from the sheet retaining unit;

resist rollers against which a leading edge of the sheet abuts;

an image forming mechanism including an endless image bearing member, means for forming a toner image onto the endless image bearing member, and means for transferring the toner image on a sheet fed by the resist rollers;

a detecting mechanism for detecting that the sheet has been picked up by the pickup roller, the detecting mechanism outputing a sheet detection signal after detecting the sheet had been picked up by the pickup roller;

a first motor for rotating the pickup roller;

a second motor for rotating the resist rollers;

a third motor for rotating the endless image bearing member; and control means for driving the first motor to rotate the pickup roller, then driving the first motor by a predetermined amount in accordance with the sheet detection signal of the detecting mechanism, and then driving the second motor and the third motor after the first motor has been driven by the predetermined amount so that the image forming mechanism forms the toner image on the sheet.

2. The image forming apparatus according to claim 1, wherein the sheet detecting mechanism detects that the sheet has reached the position of the resist rollers.

3. The image forming apparatus according to claim 2, further comprising a drive shaft for allowing the second motor to rotate the resist rollers, and wherein the sheet detecting mechanism has a sensor lever provided rotatable on the drive shaft and engageable with the leading edge of the sheet, and detection means for detecting an operation of the sensor lever and outputting the sheet detection output.

4. The image forming apparatus according to claim 3, wherein the detection means is a transmission photosensor for detecting the sensor lever.

5. The image forming apparatus according to claim 4, wherein the sheet detecting mechanism further has a cover provided above the transmission photosensor.

6. The image forming apparatus according to claim 5, wherein the cover is supported on the drive shaft of the resist rollers.

7. The image forming apparatus according to claim 6, wherein an end portion of the sensor lever abuts against the cover.

8. The image forming apparatus according to claim 6, wherein the cover has a slit where an end portion of the sensor lever is fitted and which restricts movement of the sensor lever along the drive shaft.

9. The image forming apparatus according to claim 5, wherein an end portion of the sensor lever abuts against the cover.

10. The image forming apparatus according to claim 9, wherein the cover has a slit where an end portion of the sensor lever is fitted and which restricts movement of the sensor lever along the drive shaft.

11. The image forming apparatus according to claim 5, wherein the cover has a slit where an end portion of the sensor lever is fitted and which restricts movement of the sensor lever along the drive shaft.

12. The image forming apparatus according to claim 1, wherein the control means performs control in such a way as to drive the second motor and at the same time drive the third motor to rotate the latent image carrier.

13. The image forming apparatus according to claim 1, wherein the sheet detecting mechanism detects that the sheet has reached the position of the resist rollers.

14. The image forming apparatus according to claim 13, further comprising a drive shaft for allowing the second motor to rotate the resist rollers, and wherein the sheet detecting mechanism has a sensor lever provided rotatable on the drive shaft and engageable with the leading edge of the sheet, and detection means for detecting an operation of the sensor lever and outputting the sheet detection output.

15. The image forming apparatus according to claim 14, wherein the detection means is a transmission photosensor for detecting the sensor layer.

16. The image forming apparatus according to claim 15, wherein the sheet detecting mechanism further has a cover provided above the transmission photosensor.

17. The image forming apparatus according to claim 16, wherein the cover is supported on the drive shaft of the resist rollers.

18. The image forming apparatus according to claim 17, wherein an end portion of the sensor lever abuts against the cover.

19. The image forming apparatus according to claim 17, wherein the cover has a slit where an end portion of the sensor lever is fitted and which restricts movement of the sensor lever along the drive shaft.

20. The image forming apparatus according to claim 16, wherein an end portion of the sensor lever abuts against the cover.

21. The image forming apparatus according to claim 20, wherein the cover has a slit where an end portion of the sensor lever is fitted and which restricts movement of the sensor lever along the drive shaft.

22. The image forming apparatus according to claim 16, wherein the cover has a slit where an end portion of the sensor lever is fitted and which restricts movement of the sensor lever along the drive shaft.

23. An image forming method comprising the steps of:

driving a pickup roller to pick up a sheet from a sheet retaining unit retaining sheets to cause a leading edge of the sheet to abut against resist rollers;

detecting by a detecting mechanism that the sheet has been picked up by the pickup roller;

rotating the pickup roller by a predetermined amount in accordance with the detecting of the sheet by the detecting mechanism;

driving the resist rollers to feed the sheet and driving an image forming mechanism for forming an image on the sheet after rotating of the pickup roller by the predetermined amount; and driving an image forming mechanism to form an image on the sheet fed by the resist rollers.

24. The image forming method according to claim 23, wherein the detecting step causes the detecting mechanism to detect that the sheet has reached the position of the resist rollers.

25. The image forming method according to claim 24, wherein the image forming mechanism driving step causes the image forming mechanism to form a toner image on an endless latent image carrier, rotates the image carrier and then transfers the toner image on the latent image carrier onto the sheet.

26. The image forming method according to claim 25, wherein the resist roller driving step drives the resist rollers to feed the sheet and rotates the latent image carrier of the image forming mechanism.

27. The image forming method according to claim 23, wherein the image forming mechanism driving step causes the image forming mechanism to form a toner image on an endless latent image carrier, rotates the image carrier and then transfers the toner image on the latent image carrier onto the sheet.

28. The image forming method according to claim 27, wherein the resist roller driving step drives the resist rollers to feed the sheet and rotates the latent image carrier of the image forming mechanism.

29. An image forming apparatus comprising:

a sheet retaining unit for retaining sheets;

a pickup roller for picking up a sheet from the sheet retaining unit;

resist rollers against which a leading edge of the sheet abuts;

an image forming mechanism including an endless image bearing member, means for forming a toner image onto the endless image bearing member, and means for transferring the toner image on a sheet fed by the resist rollers;

a detecting mechanism for detecting that the sheet has been picked up by the pickup roller, the detecting mechanism outputing a sheet detection signal after detecting that the sheet had been picked up by the pickup roller;

a first motor for rotating the pickup roller;

a second motor for rotating the resist rollers;

a third motor for rotating the endless image bearing member; and control means for driving the first motor to rotate the pickup roller, then driving the first motor by a predetermined amount in accordance with the sheet detection signal of the detecting mechanism, and then driving both the second motor and the third motor at the same time after the first motor has been driven by the predetermined amount, and then causing the image forming mechanism to form the toner image on the sheet.

30. An image forming apparatus comprising:

a sheet retaining unit for retaining sheets;

a pickup roller for picking up a sheet from the sheet retaining unit;

resist rollers against which a leading edge of the sheet abuts;

an image forming mechanism for forming an image on a sheet fed by the resist rollers;

a detecting mechanism for detecting that the sheet has been picked up by the pickup roller;

a first motor for rotating the pickup roller;

a second motor for rotating the resist rollers;

control means for driving the first motor to rotate the pickup roller, then driving the first motor by a predetermined amount in accordance with a sheet detection output of the detecting mechanism, and then driving the second motor, wherein the sheet detecting mechanism detects that the sheet has reached the position of the resist rollers, further comprising a drive shaft for allowing the second motor to rotate the resist rollers, and wherein the sheet detecting mechanism has a sensor lever provided rotatable on the drive shaft and engageable with the leading edge of the sheet, and detection means for detecting an operation of the sensor lever and outputting the sheet detection output.

31. An image forming apparatus comprising:

a sheet retaining unit for retaining sheets;

a pickup roller for picking up a sheet from the sheet retaining unit;

resist rollers against which a leading edge of the sheet abuts;

an image forming mechanism for forming an image on a sheet fed by the resist rollers;

a detecting mechanism for detecting that the sheet has been picked up by the pickup roller;

a first motor for rotating the pickup roller;

a second motor for rotating the resist rollers;

control means for driving the first motor to rotate the pickup roller, then driving the first motor by a predetermined amount in accordance with a sheet detection output of the detecting mechanism, and then driving the second motor, wherein the image forming mechanism includes an endless latent image carrier, a third motor for rotating the latent image carrier, image forming means for forming a toner image on the latent image carrier, and transfer means for transferring the toner image on the latent image carrier onto the sheet, wherein the sheet detecting mechanism detects that the sheet has reached the position of the resist rollers, further comprising a drive shaft for allowing the second motor to rotate the resist rollers, and wherein the sheet detecting mechanism has a sensor lever provided rotatable on the drive shaft and engageable with the leading edge of the sheet, and detection means for detecting an operation of the sensor lever and outputting the sheet detection signal.

* * * * *